US005379202A

United States Patent [19]

Daun

[11] Patent Number: 5,379,202

[45] Date of Patent: Jan. 3, 1995

[54] OUTDOOR ANIMATED HOLIDAY LIGHT DISPLAY

[75] Inventor: Daniel Daun, Hoffman Estates, Ill.

[73] Assignee: Noma International, Inc., Forest Park, Ill.

[21] Appl. No.: 51,196

[22] Filed: Apr. 22, 1993

[51] Int. Cl.[6] ..... F21P 1/00

[52] U.S. Cl. ..... 362/252; 362/251; 362/808; 40/442

[58] Field of Search ..... 362/124, 234, 251, 252, 362/806, 808, 811, 152, 240, 249; 40/442, 443, 444

[56] References Cited

U.S. PATENT DOCUMENTS 4,462,065 7/1984 Rhodes ..... 362/806 X
4,882,865 11/1989 Andeweg ..... 40/442
4,885,664 12/1989 Hermanson ..... 362/806 X

*Primary Examiner*—Stephen F. Husar
*Attorney, Agent, or Firm*—Kirschstein, Ottinger, Israel & Schiffmiller

[57] ABSTRACT

Partially overlapping display elements have light string sets mounted thereon and sequentially illuminated to simulate animation of a decorative part of an outdoor light display.

10 Claims, 3 Drawing Sheets

OUTDOOR ANIMATED HOLIDAY LIGHT DISPLAY

BACKGROUND OF THE INVENTION

1. Field of the Invention

This invention generally relates to light displays and, more particularly, to the simulation of motion on a part of an outdoor light display.

2. Description of Related Art

To celebrate Christmas, it is known to string electric lights on an outdoor wire frame staked into the ground. The frame is typically configured in a shape commemorative of the season, e.g., a Santa Claus figurine. At night, the lights are constantly or intermittently illuminated. Although quite satisfactory for their intended purpose, such light displays lose their esthetic appeal over time, since the lighting effect does not vary.

SUMMARY OF THE INVENTION

Objects of the Invention

It is a general object of this invention to provide an animated light display having a decorative part that simulates motion.

It is another object of this invention to create an esthetic, appealing holiday decoration.

Another object of this invention is to provide an attractive holiday ornament which can be manufactured and sold at a reasonable cost.

Features of the Invention

In keeping with these objects, and others which will become apparent hereinafter, one feature of this invention resides, briefly stated, in an animated light display, comprising a decoration having a decorative part to be animated. The decorative part includes a series of successive display elements. Each display element partially overlaps an adjacent display element along the series. A plurality of string sets of electric lights is supported on the display elements.

Control means are provided for simulating animation of the decorative part by sequentially illuminating the sets of lights on the display elements in succession. Only one set of lights is illuminated at any one time while all the other sets of lights are maintained extinguished.

The sequential illumination of the light sets on the partially overlapping display elements realistically simulates motion of the decorative part and creates an esthetic, appealing holiday decoration.

In the preferred embodiment, the decoration is an outdoor ornament and, to this end, means are provided for staking the decoration into the ground. Advantageously, the outdoor ornament is a rigid wire frame configured in a shape commemorative of a holiday being celebrated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
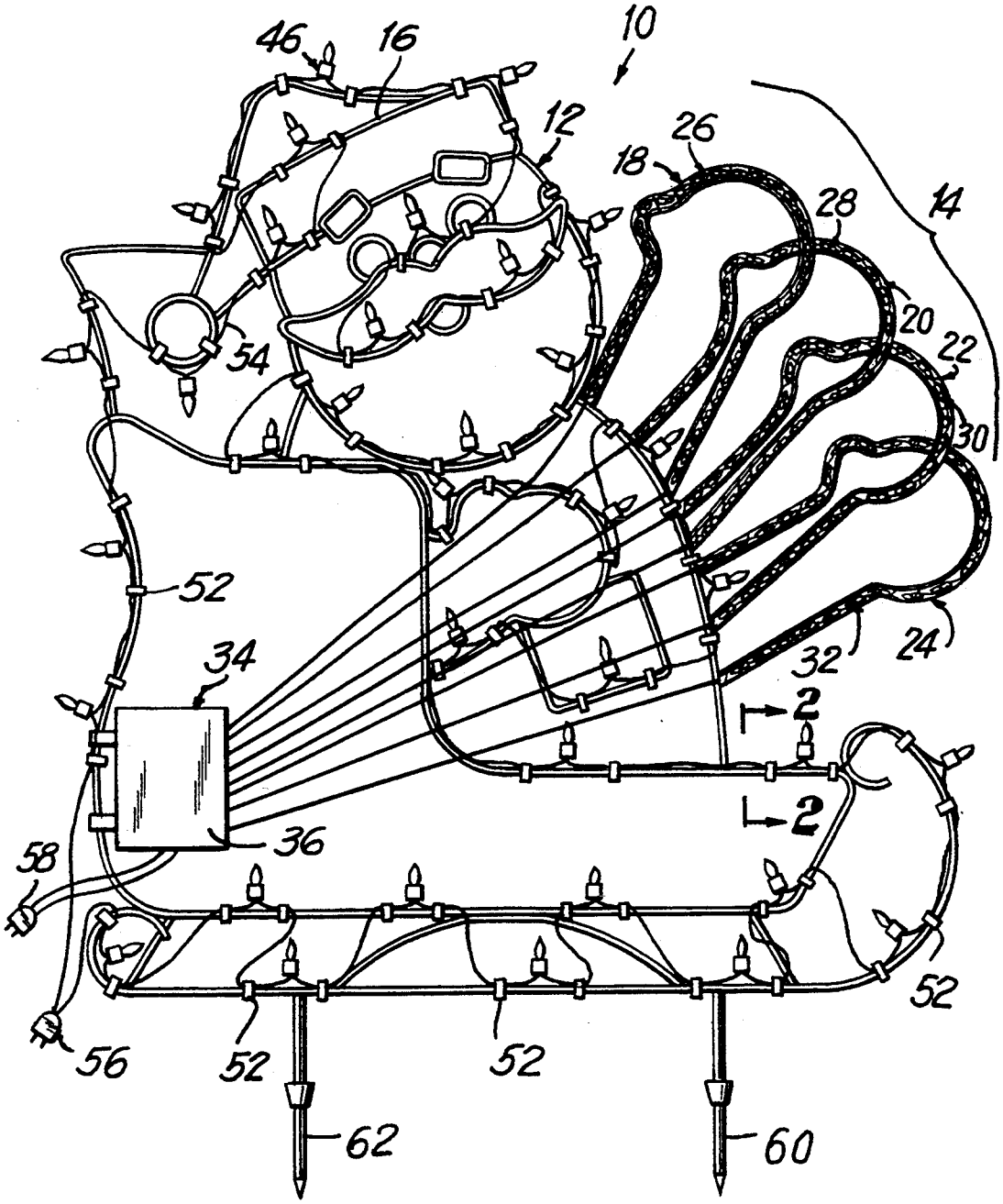
FIG. 1 is a front elevational view of an outdoor animated light display in accordance with this invention.

Referring now to the drawings, reference numeral 10 generally identifies an animated light display including a decoration 12 having virtually any desired shape. In the illustrated case, a Santa Claus figurine sitting in a sleigh laden with a gift sack and having an outstretched arm is shown. As explained below, one aspect of this invention is to simulate motion of a decorative part 14 of the display and, in the illustrated case, this is done by "waving" Santa Claus's outstretched arm. Other decorations commemorative of the Christmas season include a bell having a clapper as the animated decorative part, the clapper appearing to be swinging from side to side to ring the bell. Another decoration is a reindeer having front feet as the animated decorative part, the front feet appearing to be prancing. Of course, decorations commemorative of other holidays are contemplated by this invention. Non-holiday decoration, such as advertising displays for attracting attention by simulating movement of a part of the display, are also within the spirit of this invention.

In the preferred embodiment, decoration 12 is a rigid wire frame 16, and the decorative part 14 to be aminated is a series of successive display elements 18, 20, 22, 24. In the illustrated case, each display element resembles an outstretched arm. Element 22 partially overlaps element 24; element 20 partially overlaps element 22; and element 18 partially overlaps element 20. The display elements 18, 20, 22, 24 are angularly offset relative to one another.

Figure 4:
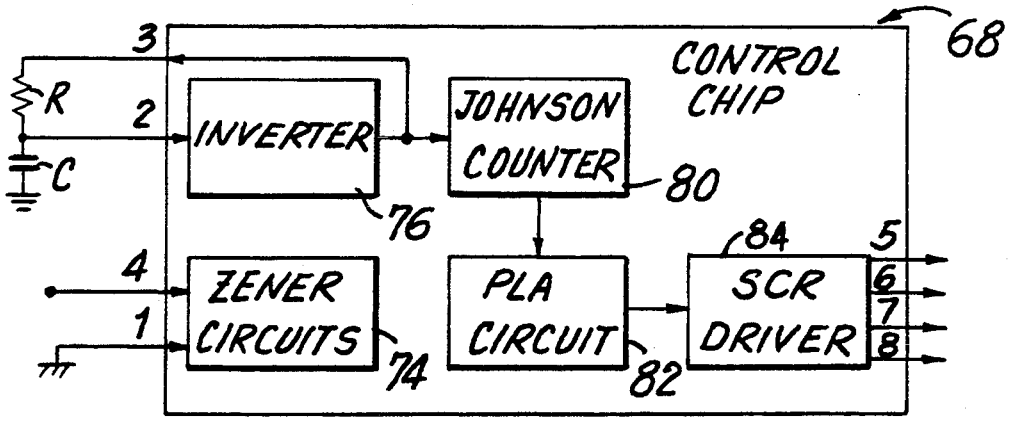
FIG. 4 is a block diagram of a control chip used to control the operation of the light display of FIG. 1.

Display 10 further includes a plurality of string sets of electric lights supported on the display elements. Thus, first, second, third and fourth light sets 26, 28,30, 32 are respectively mounted on display elements 18, 20, 22, 24. Each light set is electrically connected to a controller 34 mounted within a housing 36 that is clipped on the wire frame 16. The structure and operation of the controller 34 is discussed below in connection with FIGS. 4 and 5.

Figure 3:
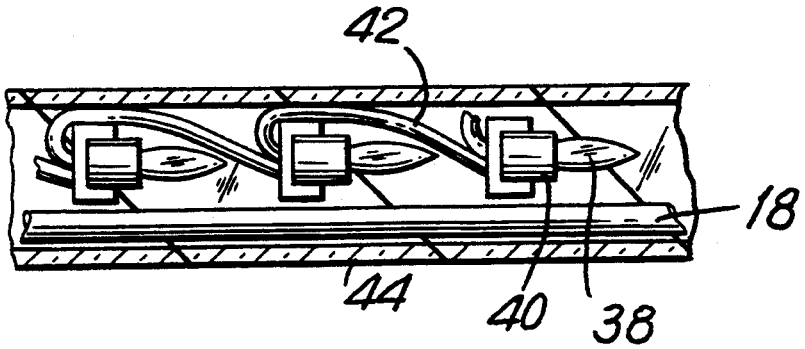
FIG. 3 is an enlarged, broken-away view of a detail of FIG. 1.

Each light of the light sets 26–32 is a miniature light and, as illustrated in FIG. 3, includes a bulb 38 plugged or screwed into a socket 40 which, in turn, is wired by a conductor 42 to an adjacent socket, and so on, along the string set. In the preferred embodiment, about thirty of such bulbs and sockets are included in each light set 26–32 and are spaced about four cm apart. Preferably, each of these bulbs 38 has the same color, e.g., white.

The light sets 26–32 are secured in place on their display elements. This can be accomplished by clips, ties or analogous connectors. In this case, as shown in FIG. 3, a sleeve 44 having a spiral slit along its length is mounted on, and wrapped around, each display element. The bulbs 38 and their sockets 40 are positioned beneath a respective sleeve and lie generally parallel to, and along, a respective display element. The sleeve is made of a light-transmissive material to enable the light of the illuminated bulbs to pass therethrough and, by encircling both the display element, the bulbs 38 and the sockets 40, form a more weather- and wind-resistant enclosure.

Figure 2:
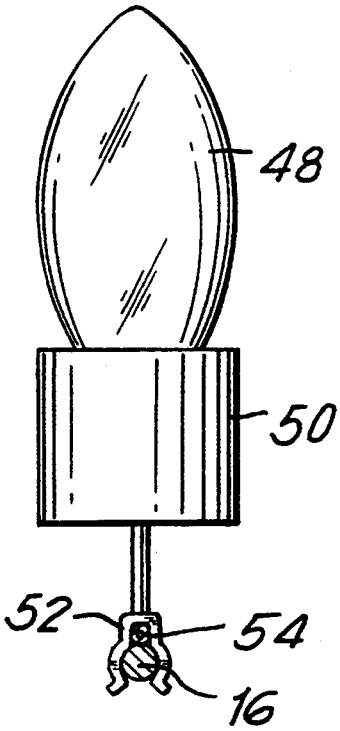
FIG. 2 is an enlarged, sectional view taken along line 2—2 of FIG. 1.

Display 10 further includes additional light sets strung over the remainder of the decoration. Thus, another light set 46 is mounted on and about the wire frame 16, especially about its periphery to outline the decoration. This additional light set 46 also includes, as shown in FIG. 2, a plurality of bulbs 48 plugged or screwed into sockets 50 electrically interconnected by wires 54. Bulbs 48 are preferably of a larger size and of a different color, e.g., red, as compared to bulbs 38. A plurality of mounting clips 52, preferably constituted of spring steel, are successively positioned along, and clipped onto, the wires 54, over the wire frame 16, thereby firmly securing the light sets thereto. The wires 54 connect the bulbs 48 to the controller 34, or, as shown, to an electric power plug 56. The controller 34 has its own electric plug 58 to power the controller.

A set of stakes 60, 62 spaced apart of each other and rigidly connected to the wire frame is inserted into the ground to anchor the frame in place as an outdoor decoration.

Figure 5:
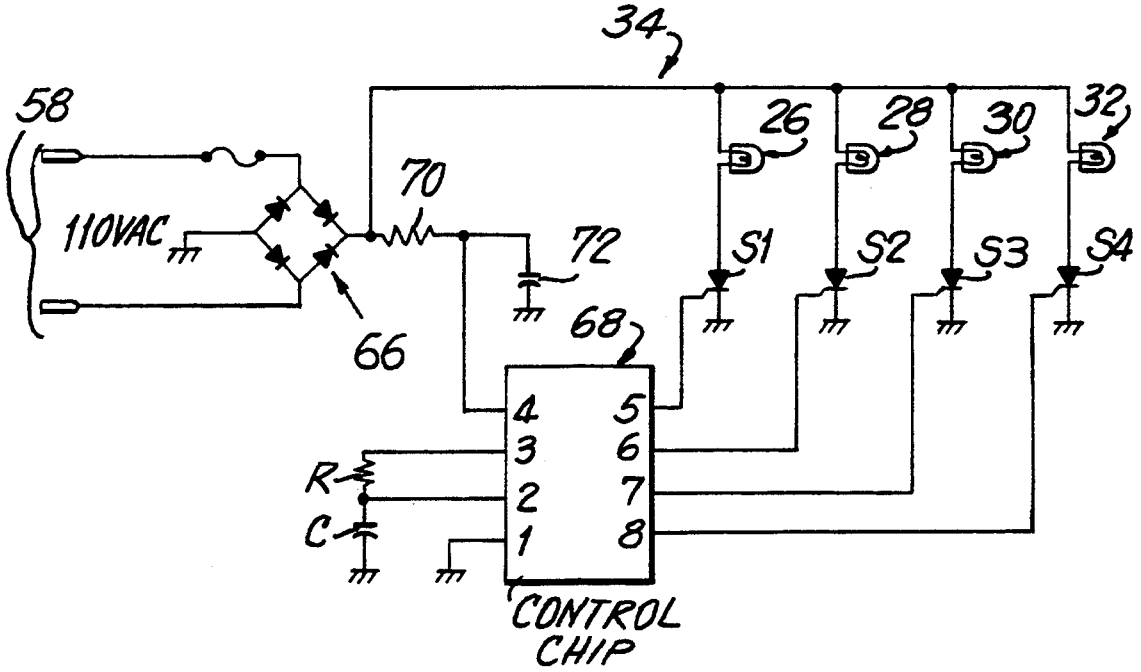
FIG. 5 is an electrical schematic of a control circuit utilizing the control chip of FIG. 4 to operate the display.

Turning next to FIG. 5, controller 34 is electrically connected to the light sets 26–32 as follows. To simplify the drawing, each light set 26, 28, 30, 32 in FIG. 5 has been represented by a single bulb. AC voltage at the plug 58 is supplied via a fuse 64 to a bridge rectifier 66 and, thereupon, the rectified voltage is conducted to one side of each light set, as well as through a voltage-dropping resistor 70 to a power input terminal 4 of a control chip 68. Power terminal 4 is connected to ground via a capacitor 72. An input terminal 1 is grounded. The power terminals 1 and 4 are connected to an internal Zener circuit 74 (see FIG. 4).

An external resistor R is connected across input timer terminals 2, 3 of the control chip 68. Timer terminal 2 is also connected to ground via external capacitor C. The external resistor R and capacitor C, together with an internal inverter 76 (see FIG. 4), comprise a ring oscillator for generating clock timing signals whose frequency is determined by the values of the exterior resistor R and capacitor c.

The clock signals are supplied to a conventional Johnson counter 80 constituted of a pair of D-type flip-flop devices. The counter 80 generates a non-overlapping signal which is supplied to a programmable logic array (PLA) circuit 82 which is pre-programmed to generate a light control pattern. The PLA circuit 82 generates a drive signal to drive a silicon-controlled rectifier (SCR) driver 84 having four output terminals 5, 6, 7 and 8 which are respectively connected to the gates of silicon-controlled rectifiers or power switches S1, S2, S3, S4. Power switches S1–S4 are respectively connected in series between light sets 26–32 and ground.

In use, the outdoor light display is staked into the ground and connected to power via electric plugs 56, 58. The controller 34 initially illuminates light set 26, and maintains extinguished all the other light sets 28, 30, 32, thereby resulting in illumination of the outline of the display element 18. Thereupon, controller 34 illuminates light set 28, while maintaining extinguished all the other light sets 26, 30, 32, thereby resulting in illumination of only the outline of display element 20. Next, the controller 34 illuminates light set 30, while maintaining all the other light sets 26, 28, 32 extinguished, again resulting in illumination of only the outline of display element 22. Next, controller 34 illuminates light set 32, while maintaining all the other light sets 26, 28, 30 extinguished, thereby resulting in illumination of only the outline of display element 24. Thereupon, the illumination sequence reverses, and controller 34 next illuminates light set 30 to illuminate only the outline of display element 22, and next illuminates light set 28 to illuminate only the outline of display element 20, and next illuminates light set 26 to illuminate only the outline of display element 18. This sequential and reversible illumination of the display elements 18–24 is repeated for as long as desired.

Thus, the display elements 18–24 are sequentially illuminated by a speed determined by the values of the external resistor R and the capacitor C. As a result the animation of the decorative part 14 is obtained, in this case, the waving of the Santa Claus's outstretched arm. The effect is all the more realistic and continuous due to the partial overlapping of the display elements.

It will be understood that each of the elements described above, or two or more together, also may find a useful application in other types of constructions differing from the types described above.

While the invention has been illustrated and described as embodied in an outdoor animated holiday light display, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An animated light display, comprising:

(a) a decoration having a decorative part to be animated, said decorative part having a series of successive display elements, each display element partially overlapping an adjacent display element along the series;

(b) a plurality of string sets of electric lights supported on the display elements; and (c) control means for simulating animation of the decorative part by sequentially illuminating the sets of lights on the display elements in succession, only one set of lights being illuminated at any one time while all the other sets of lights are maintained extinguished.

2. The animated display according to claim 1, wherein the decoration is an outdoor ornament, and includes means for staking the decoration into the ground.

3. The animated display according to claim 1, wherein the decoration is a rigid wire frame configured as a holiday ornament.

4. The animated display according to claim 1, wherein the decoration is a rigid wire frame on and along which the sets of electric lights are strung.

5. The animated display according to claim 4; and further comprising a spiral support sleeve encircling portions of each set of lights.

6. The animated display according to claim 1; and further comprising an additional string set of electric lights supported on another part of the decoration.

7. The animated display according to claim 6; and further comprising mounting clips for securing the additional set to said other part of the decoration.

8. The animated display according to claim 1, wherein the control means includes a plurality of power switches, each connected to a respective set of lights, and means for generating drive signals, each sequentially applied to a respective power switch to illuminate the set connected to said respective power switch.

9. An outdoor animated holiday light display, comprising:

(a) a rigid wire frame having an ornamental configuration, said frame having a decorative frame part to be animated, said frame part having a series of successive display elements, each display element partially overlapping an adjacent display element along the series;

(b) a plurality of string sets of electric lights supported on the display elements; and (c) control means for simulating animation of the decorative part by sequentially illuminating the sets of lights on the display elements in succession, only one set of lights being illuminated at any one time while all the other sets of lights are maintained extinguished.

10. The animated display according to claim 9, wherein the frame has stakes for staking the frame into the ground.

* * * * *